US012396582B2

(12) United States Patent
Li

(10) Patent No.: US 12,396,582 B2
(45) Date of Patent: Aug. 26, 2025

(54) AUTOMATIC DECANTING APPARATUS

(71) Applicant: Ningbo Aoren Plastic Products Co., Ltd., Zhejiang (CN)

(72) Inventor: Xuneng Li, Zhejiang (CN)

( * ) Notice: Subject to any disclaimer, the term of this patent is extended or adjusted under 35 U.S.C. 154(b) by 0 days.

(21) Appl. No.: 19/001,417

(22) Filed: Dec. 25, 2024

(65) Prior Publication Data

US 2025/0213059 A1 Jul. 3, 2025

(30) Foreign Application Priority Data

Dec. 27, 2023 (CN) ..... 202323584810.X

(51) Int. Cl.
*A47G 23/02* (2006.01)

(52) U.S. Cl.
CPC ..... *A47G 23/0241* (2013.01)

(58) Field of Classification Search
CPC ..... A47J 36/2438; B01F 31/10; B01F 31/20; B01F 31/25; B01F 31/441; B01F 31/50; B01F 31/65
USPC ..... 99/277.1; 366/209, 211, 217, 275
See application file for complete search history.

(56) References Cited

U.S. PATENT DOCUMENTS

| | | | | |
|---|---|---|---|---|
| 2,499,203 A * | 2/1950 | Warren | B01F 31/65 366/275 |
| 3,181,841 A * | 5/1965 | Boehm | B01F 31/10 366/217 |
| 3,643,671 A * | 2/1972 | Henninges | C23F 1/08 156/345.23 |
| 4,907,723 A * | 3/1990 | Katz | B67D 3/0012 222/196 |
| 8,132,960 B2 * | 3/2012 | Zhuang | B01F 31/201 366/209 |
| 2004/0151064 A1 * | 8/2004 | Yi | B01F 31/20 366/209 |
| 2007/0289977 A1 * | 12/2007 | Zhuang | F25D 3/06 220/592.16 |

* cited by examiner

*Primary Examiner* — Chris Q Liu
(74) *Attorney, Agent, or Firm* — Hawaii Patent Services; Nathaniel K. Fedde; Kenton N. Fedde

(57) ABSTRACT

The present disclosure provides an automatic decanting apparatus, including a base assembly, a drive motor and a shaking seat. A transmission assembly is arranged between the base assembly and the shaking seat, the base assembly is provided with an arc groove corresponding to the shaking seat, and the shaking seat is slidably arranged on the arc groove of the base assembly. The shaking seat and the base assembly are slidably connected through a guide mechanism, the drive motor is in transmission connection with the transmission assembly, and under a guiding action of the guide mechanism, the shaking seat is driven to swing back and forth along an arc end face of the arc groove.

15 Claims, 11 Drawing Sheets

C-C

E

AUTOMATIC DECANTING APPARATUS

CROSS-REFERENCE TO RELATED APPLICATIONS

The present application claims priority to Chinese Patent Application No. 202323584810X, filed on Dec. 27, 2023 and entitled "AUTOMATIC DECANTING APPARATUS", the content of which and its modified content incorporated herein by reference in its entirety.

TECHNICAL FIELD

The present disclosure relates to the technical field of decanting apparatuses, in particular to an automatic decanting apparatus.

BACKGROUND

Red wine decanting, in simple terms, is a process of pouring red wine from an originally sealed bottle into another container (usually a decanter), allowing the red wine to make full contact with the air and undergo a series of physical and chemical changes. After coming into contact with oxygen in the air, the red wine undergoes oxidation, causing tannins in the wine to gradually soften, resulting in a smoother and more rounded taste, and reducing the sourness and astringency.

A traditional decanting method is to pour the wine into a glass and shake the red wine to make foreign flavors and methanol that were originally sealed in the wine evaporate. The aroma of the wine is allowed to be released, which further enhances the taste of the red wine. Another way is to pour red wine into a decanter in advance and drink it immediately when needed, but current decanting methods are often inefficient and time-consuming and labor-consuming during decanting. Therefore, many electric decanting apparatuses are developed. For example, an existing Chinese patent with the publication number CN219594408U discloses an intelligent wine decanting apparatus.

However, the above automatic decanting apparatuses have the following disadvantages: the decanting apparatuses can only perform linear reciprocating translation, the shaking of wine is poor, the contact area between the wine and the air is small, resulting in a longer decanting time, and in addition, such linear oscillating type decanters are prone to causing the wine in decanting bottles to shake and spill out during shaking.

Therefore, it is necessary to propose a novel decanting apparatus to solve the above-mentioned problems.

SUMMARY

The present disclosure provides an automatic decanting apparatus to solve the problems mentioned in the background above.

In order to implement the above inventive objectives, the present disclosure provides an automatic decanting apparatus, including a base assembly, a drive motor and a shaking seat. A transmission assembly is arranged between the base assembly and the shaking seat, the base assembly is provided with an arc groove corresponding to the shaking seat, and the shaking seat is slidably arranged on the arc groove of the base assembly. The shaking seat and the base assembly are slidably connected through a guide mechanism, the drive motor is in transmission connection with the transmission assembly, and under a guiding action of the guide mechanism, the shaking seat is driven to swing back and forth along an arc end face of the arc groove.

The present disclosure further provides an automatic decanting apparatus, including a base assembly, and a shaking seat movably arranged on the base assembly. The base assembly has a moving area allowing the shaking seat to move with an arc trajectory, and the shaking seat reciprocates in the moving area; a guide mechanism is arranged between the shaking seat and the base assembly, and the guide mechanism is used to connect the shaking seat and the base assembly, and guide the shaking seat to move along the arc trajectory; and the base assembly and/or the shaking seat are/is provided with a drive mechanism used to drive the shaking seat to reciprocate automatically.

BRIEF DESCRIPTION OF DRAWINGS

The accompanying drawings constituting a part of the present application are intended to provide a further understanding of the present disclosure, and schematic embodiments of the present disclosure and their illustrations are used to explain the present disclosure, and do not constitute an appropriate limitation to the present disclosure. In the accompanying drawings.

Figure 1:
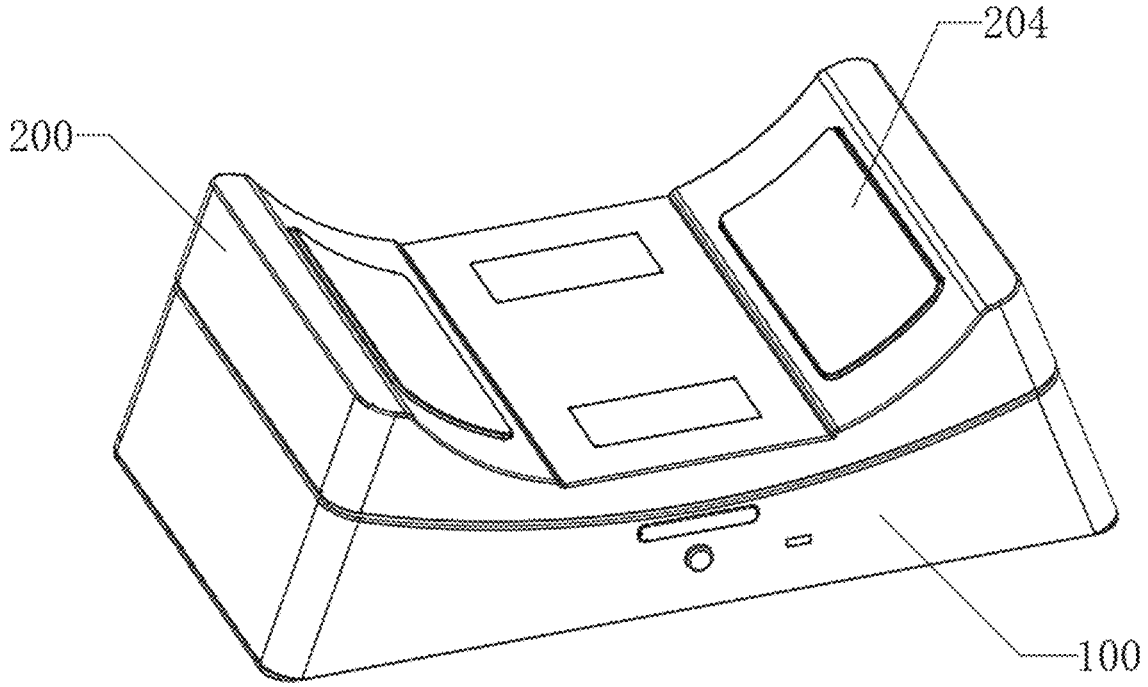
FIG. 1 shows a structural diagram of the present disclosure.
Figure 2:
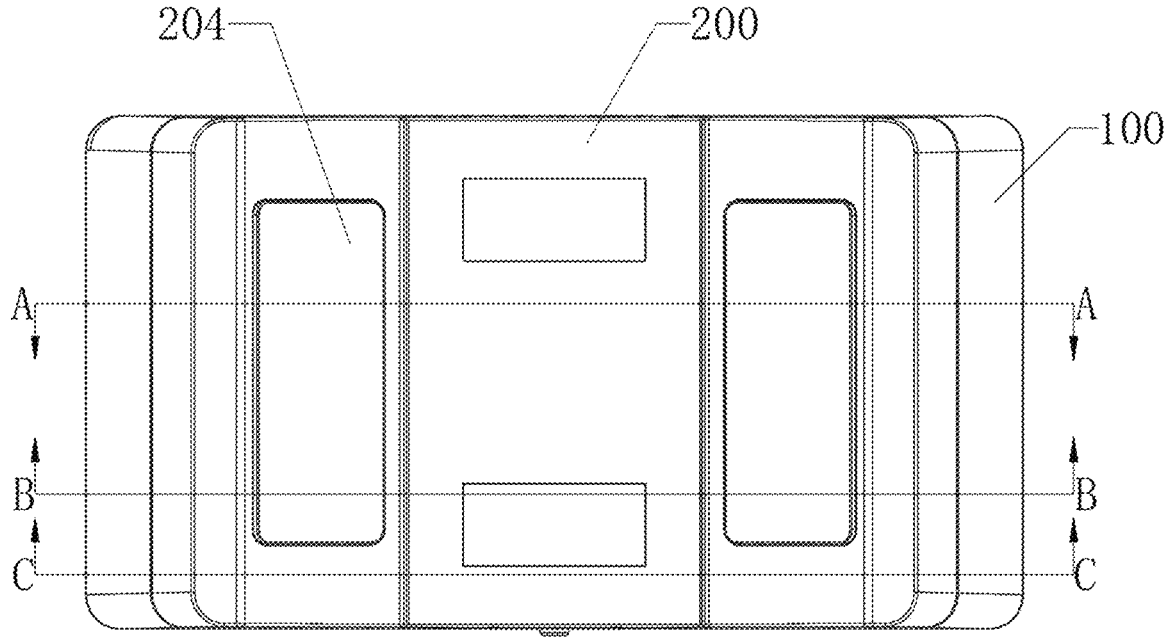
FIG. 2 is a top view of FIG. 1.
Figure 3:
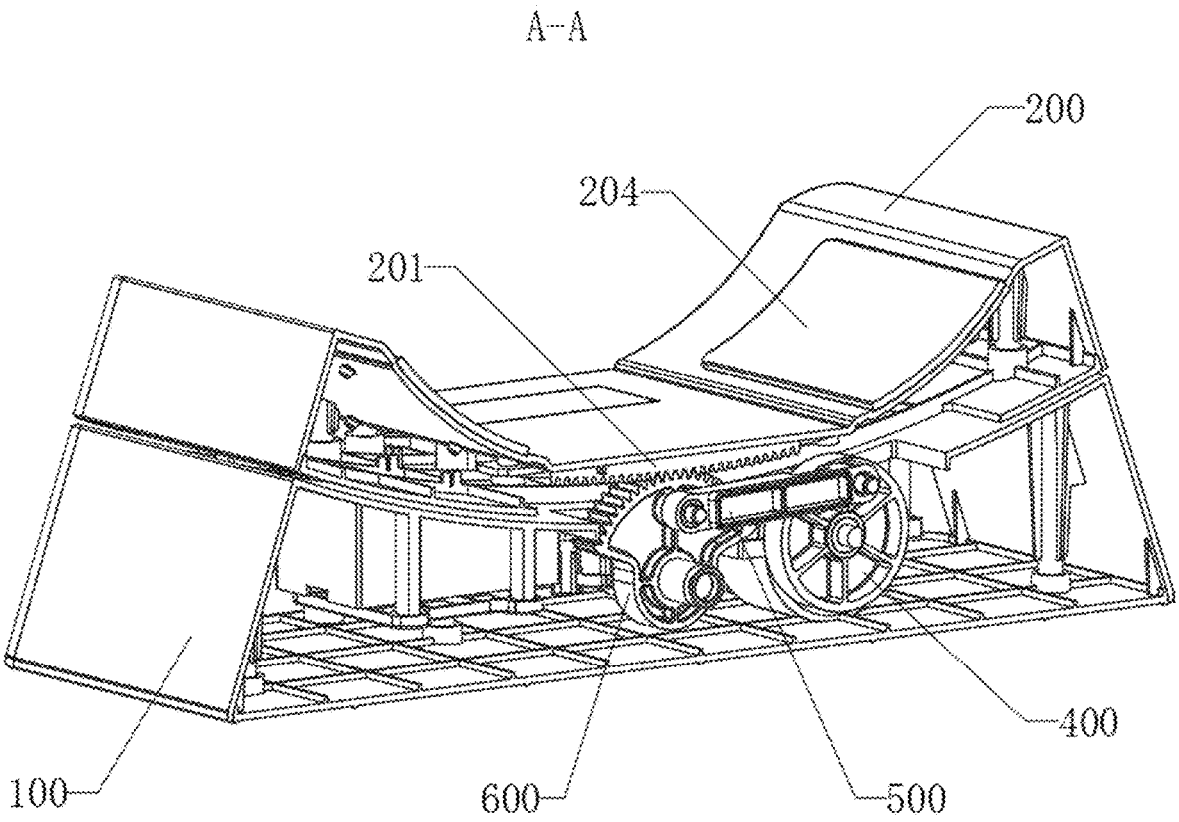
FIG. 3 is a sectional view at a position A-A in FIG. 2.

REFERENCE NUMERALS base assembly (100); bottom shell (101); fixing frame (102); arc groove (103); track groove (104); mounting groove (105); shaking seat (200); rack (201); guide member (202); arc supporting part (203); clamping part (204); drive motor (300); rotary table (400); link rod (500); transmission gear (600); roller (700); and sector included angle ($\alpha$).

DESCRIPTION OF EMBODIMENTS

The technical solution in embodiments of the present disclosure will be clearly and completely described below in combination with the accompanying drawings in the embodiments of the present disclosure. Apparently, the described embodiments are part of the embodiments of the present disclosure, not all of them. The following description of at least one exemplary embodiment is actually illustrative, and should not be construed as any limitation on the present disclosure and its application or use. Based on the embodiments of the present disclosure, all other embodiments obtained by those of ordinary skill in the art without any creative work fall within the protection scope of the present disclosure.

It should be noted that the terms used here are only intended to describe specific implementations and are not intended to limit exemplary implementations according to the present application. As used herein, unless otherwise explicitly stated in the context, the singular form is also intended to include the plural form. Additionally, it should further be understood that, when the terms "comprising" and/or "including" are used in this specification, they indicate the presence of features, steps, operations, devices, assemblies and/or combinations thereof.

Unless otherwise specified specifically, the relative arrangement, numerical expressions and values of components and steps described in these embodiments do not limit the scope of the present disclosure. At the same time, it should be understood that for ease of description, the dimensions of the various parts shown in the accompanying drawings are not drawn according to an actual proportional relation. For techniques, methods, and devices known to those of ordinary skill in the related art, detailed discussions may not be made, but in appropriate circumstances, such techniques, methods, and devices should be considered as part of the granted specification. In all the examples shown and discussed here, any specific value should be interpreted as illustrative and not restrictive. Therefore, other examples of exemplary embodiments may have different values. It should be noted that: similar numerals and letters represent similar items in the following accompanying drawings. Therefore, once an item is defined in one accompanying drawing, it does not need to be further discussed in subsequent accompanying drawings.

Referring to FIG. 1 to FIG. 12, the present disclosure discloses an automatic decanting apparatus, including a base assembly 100, a drive motor 300 and a shaking seat 200. A transmission assembly is arranged between the base assembly 100 and the shaking seat 200, the base assembly 100 is provided with an arc groove 103 corresponding to the shaking seat 200, and the shaking seat 200 is slidably arranged on the arc groove 103 of the base assembly 100. The shaking seat 200 and the base assembly 100 are slidably connected through a guide mechanism, the drive motor 300 is in transmission connection with the transmission assembly, and under a guiding action of the guide mechanism, the shaking seat 200 is driven to swing back and forth along an arc end face of the arc groove 103. Clamping parts 204 used to clamp and fix a decanting bottle are symmetrically arranged at an end of the shaking seat 200 away from the base assembly 100.

In the present embodiment, the clamping parts 204 are pads, and when the decanting bottle is placed on the shaking seat 200, the clamping parts 204 arranged symmetrically may abut against two ends of the decanting bottle so as to stabilize the decanting bottle and prevent the decanting bottle from slipping when the shaking seat 200 moves left and right.

In other embodiments (not shown in the figures), the clamping parts 204 may further be in a stepped shape, decanting bottles with different diameters may be clamped on the symmetrically-arranged clamping parts 204 to be held, and the clamping adaptability for decanting bottles of different sizes is improved.

As shown in FIG. 4, FIG. 5, FIG. 8 and FIG. 10, the guide mechanism includes guide members 202 and track grooves 104, the track grooves 104 are formed in the base assembly 100, the track grooves 104 communicate with the arc groove 103, the guide members 202 are fixedly connected to the shaking seat 200, and the guide members 202 are arranged in the track grooves 104 in an anti-disengaging mode and are in guiding fit with the track grooves. The guide members 202 are connected into the track grooves 104 in the anti-disengaging mode, so that the shaking seat 200 is slidably mounted on the base assembly 100. Meanwhile, the guide members 202 are in guiding fit with the track grooves 104, so that the shaking seat 200 can arcuately swing back and forth along an arc end face of the arc groove 103.

In the present embodiment, there are four track grooves 104, the four track grooves 104 are symmetrically distributed on two sides of the base assembly 100 with every two of them as a group, four guide members 202 are adaptively arranged corresponding to the track grooves 104, and the four guide members 202 and the four track grooves 104 are connected in one-to-one correspondence.

Figure 4:
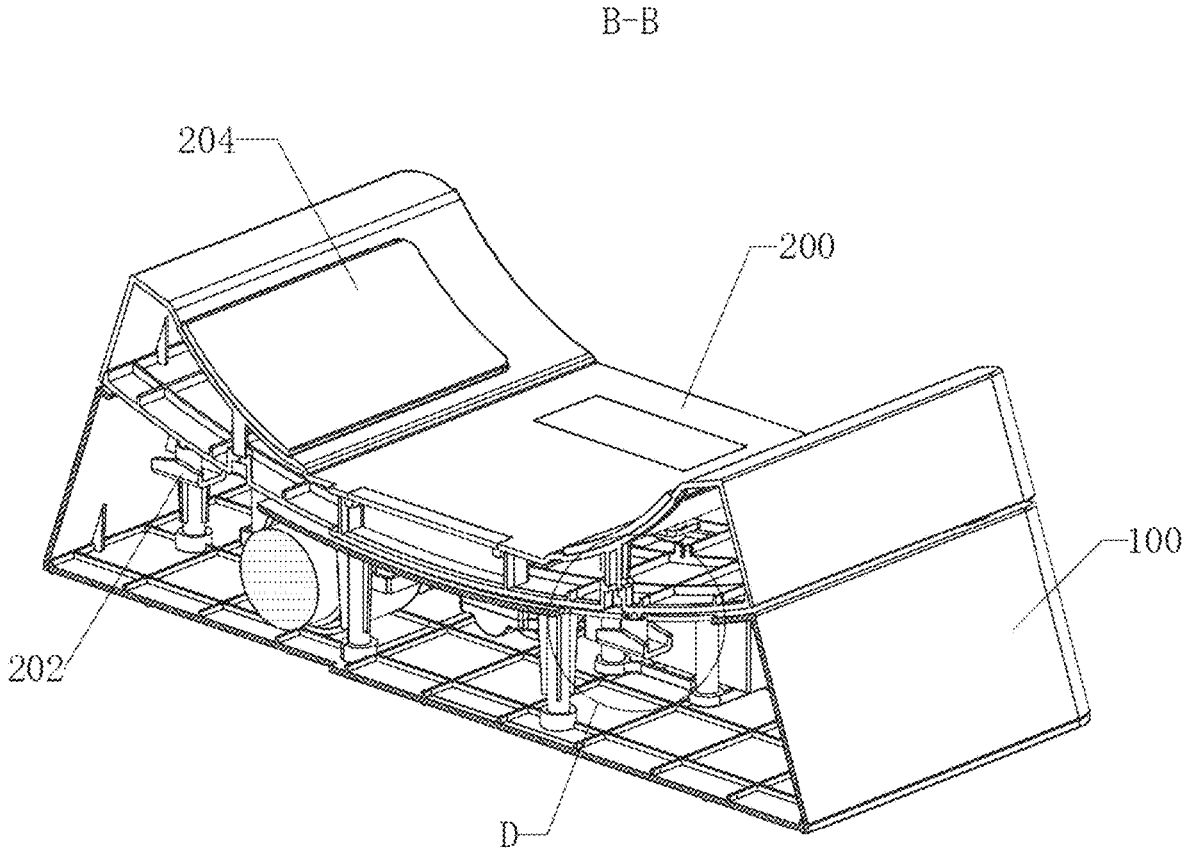
FIG. 4 is a sectional view at a position B-B in FIG. 2.
Figure 5:
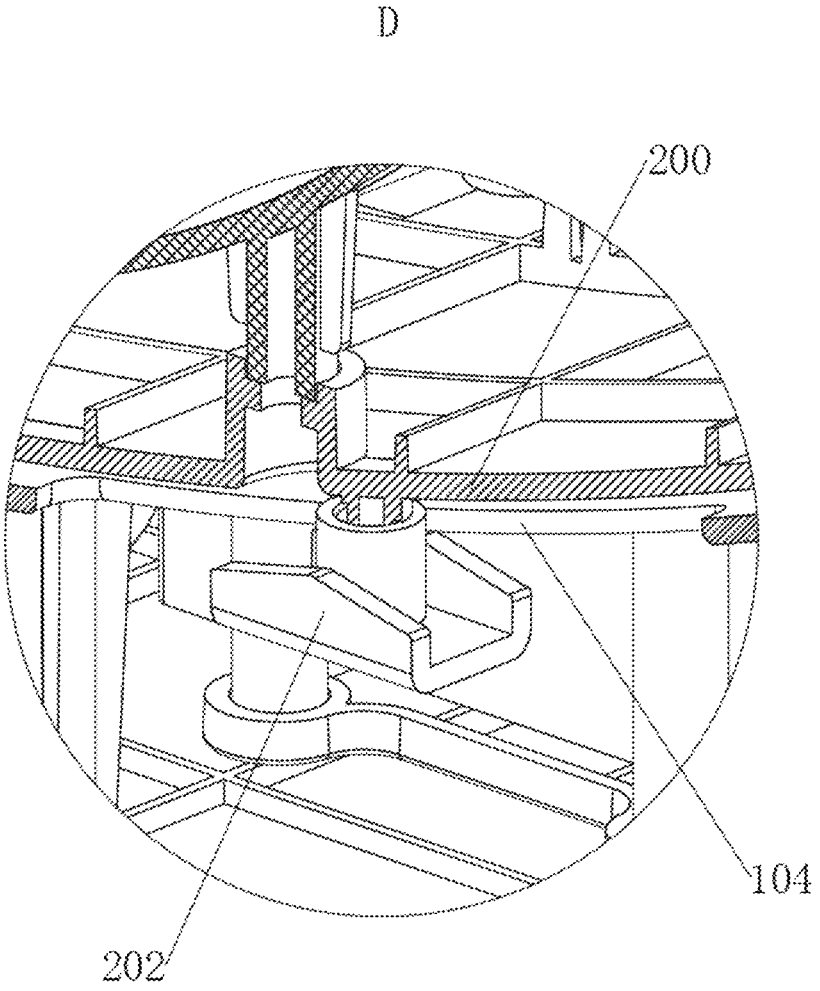
FIG. 5 is a partially amplified schematic diagram for a position D in FIG. 4.

As shown in FIG. 4 and FIG. 5, in the present embodiment, each track groove 104 is in a through-groove form, the guide members 202 penetrate through the track grooves 104, widths of the guide members 202 are greater than groove widths of the track grooves 104, and at the same time, tops of the guide members 202 are slidably connected with bottom surfaces of the track grooves 104. Therefore, the guide members 202 cannot be disengaged from the track grooves 104 upwards, so it is guaranteed that the shaking seat 200 and the base assembly 100 are stably connected together. Meanwhile, when the shaking seat 200 reciprocates, a movement guiding action can further be played.

Of course, implementations of the guide mechanism are not merely limited to the above form, and in other embodiments (not shown in the figures), the track grooves 104 may further be replaced with the form of dovetail guide rails or dovetail grooves, while the guide members 202 are correspondingly arranged in a matching shape. In this way, while a sliding guidance action is achieved, an action of connecting the base assembly 100 and the shaking seat 200 can still be achieved. Similarly, other guide mechanisms with connection and guidance actions are also applicable to the present disclosure.

As shown in FIG. 3, and FIG. 8 to FIG. 12, in the present embodiment, a drive mechanism includes a transmission assembly and a drive motor 300. The transmission assembly includes a rack 201, a transmission gear 600 and a linkage component, the rack 201 is fixedly connected to the shaking seat 200, the transmission gear 600 is rotatably connected to the base assembly 100, the rack 201 and the transmission gear 600 are engaged, and the drive motor 300 drives the transmission gear 600 to rotate back and forth through the linkage component. When the drive motor 300 drives the transmission gear 600 to rotate back and forth through the linkage component, under a point-engaging action of the rack 201 and the transmission gear 600, the shaking seat 200 is driven to shake left and right relative to the base assembly 100.

The linkage component includes a rotary table 400 and a link rod 500, the rotary table 400 is coaxially and fixedly arranged on an output shaft of the drive motor 300, one end of the link rod 500 is rotatably connected to an eccentric site of the transmission gear 600, and the other end of the link rod 500 is rotatably connected to an eccentric site of the rotary table 400. The drive motor 300 drives the rotary table 400 to rotate coaxially, the rotary table 400 drives an end of the link rod 500 close to the rotary table 400 to move circumferentially, at the same time, the other end of the link rod 500 drives the transmission gear 600 to rotate back and forth, and under engaging of the rack 201 and the transmission gear 600, the shaking seat 200 is driven to swing back and forth along the arc groove 103 relative to the base assembly 100.

In the present embodiment, the transmission gear 600 is arranged as a sector gear, and a sector included angle α of the sector gear is set to be 130° to 150°. In the present embodiment, the sector included angle α is set to be 138°, since the transmission gear 600 always rotates back and forth, the design of the sector gear may greatly reduce a mounting space for the transmission gear 600, and thus the present disclosure is smaller.

The drive mechanism is not merely limited to the above implementation, in other embodiments of the drive mechanism (not shown in the figure), the drive mechanism may also be an electric telescopic rod or air cylinder, and the shaking seat 200 can also be pushed to reciprocate left and right on the base assembly 100 through extension and retraction of the electric telescopic rod or air cylinder. The drive mechanism is not merely limited to being mounted on the base assembly 100, and according to drive forms of different drive mechanisms, the drive mechanism may also be selectively mounted on the base assembly 100 or the shaking seat 200, so that the adaptability of the present disclosure is improved.

Figure 6:
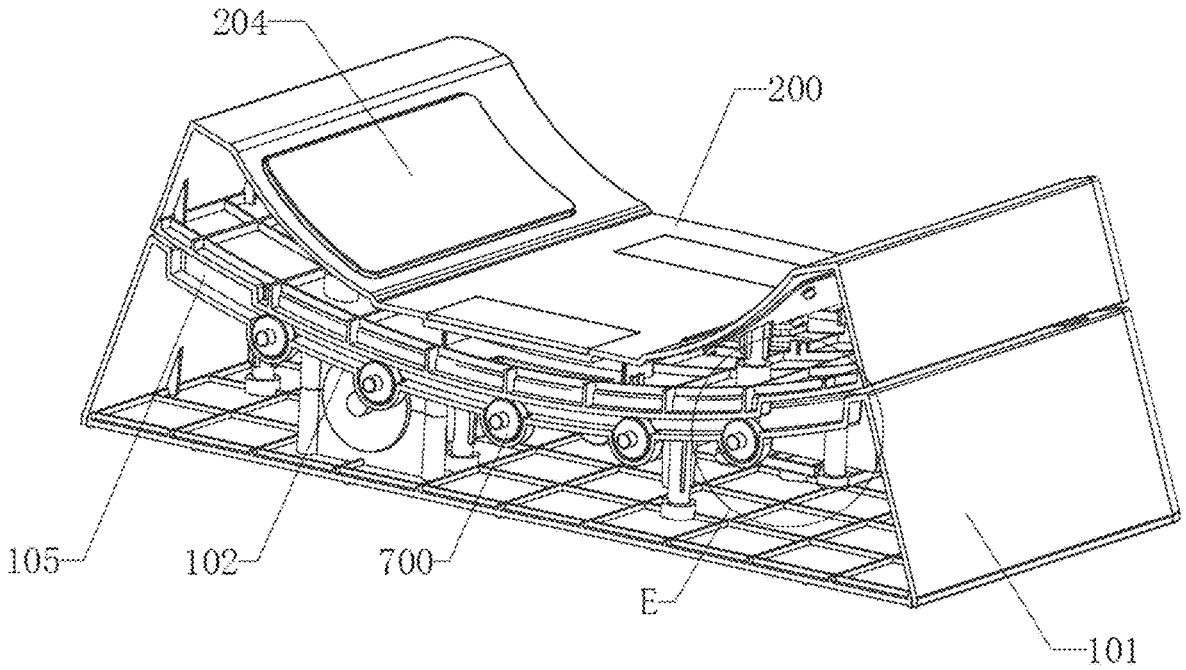
FIG. 6 is a sectional view at a position C-C in FIG. 2.
Figure 7:
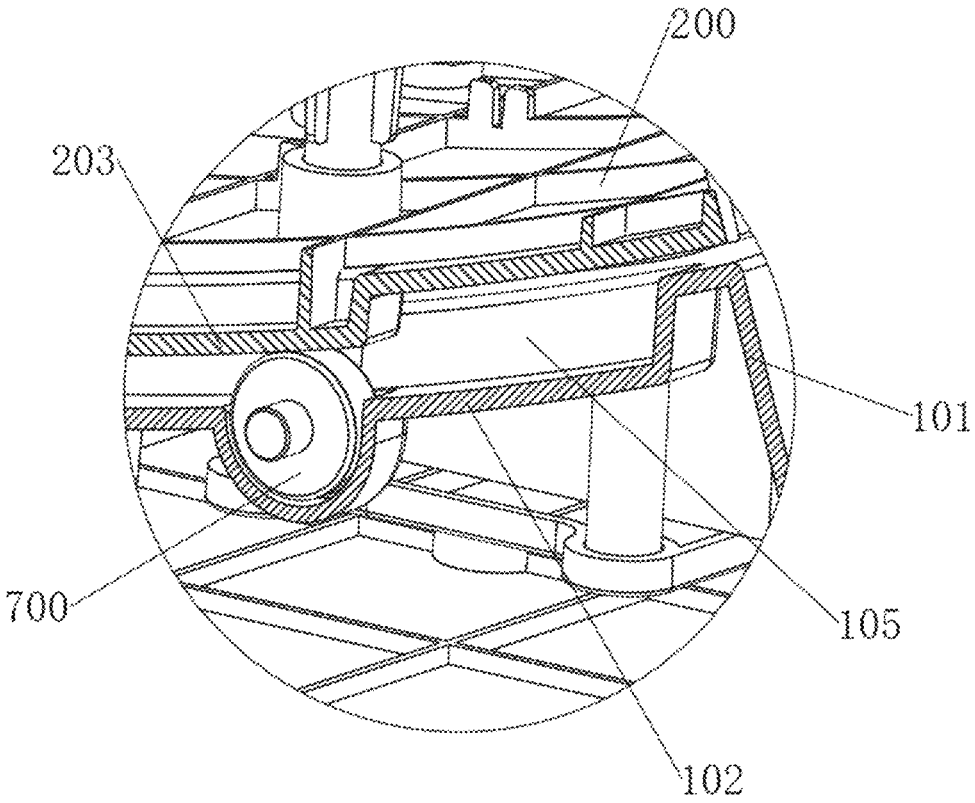
FIG. 7 is a partially amplified schematic diagram for a position E in FIG. 6.
Figure 8:
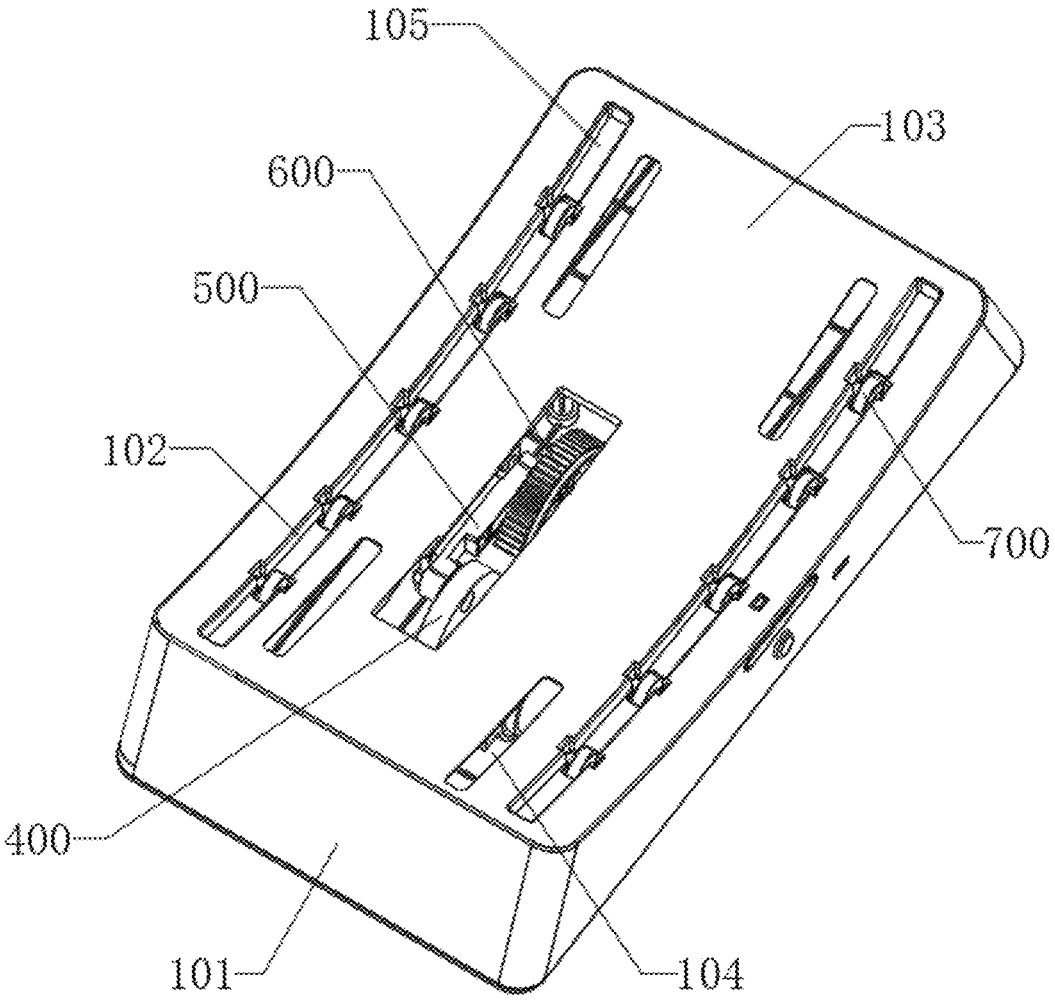
FIG. 8 shows a schematic structural diagram of a base assembly in the present disclosure.
Figure 9:
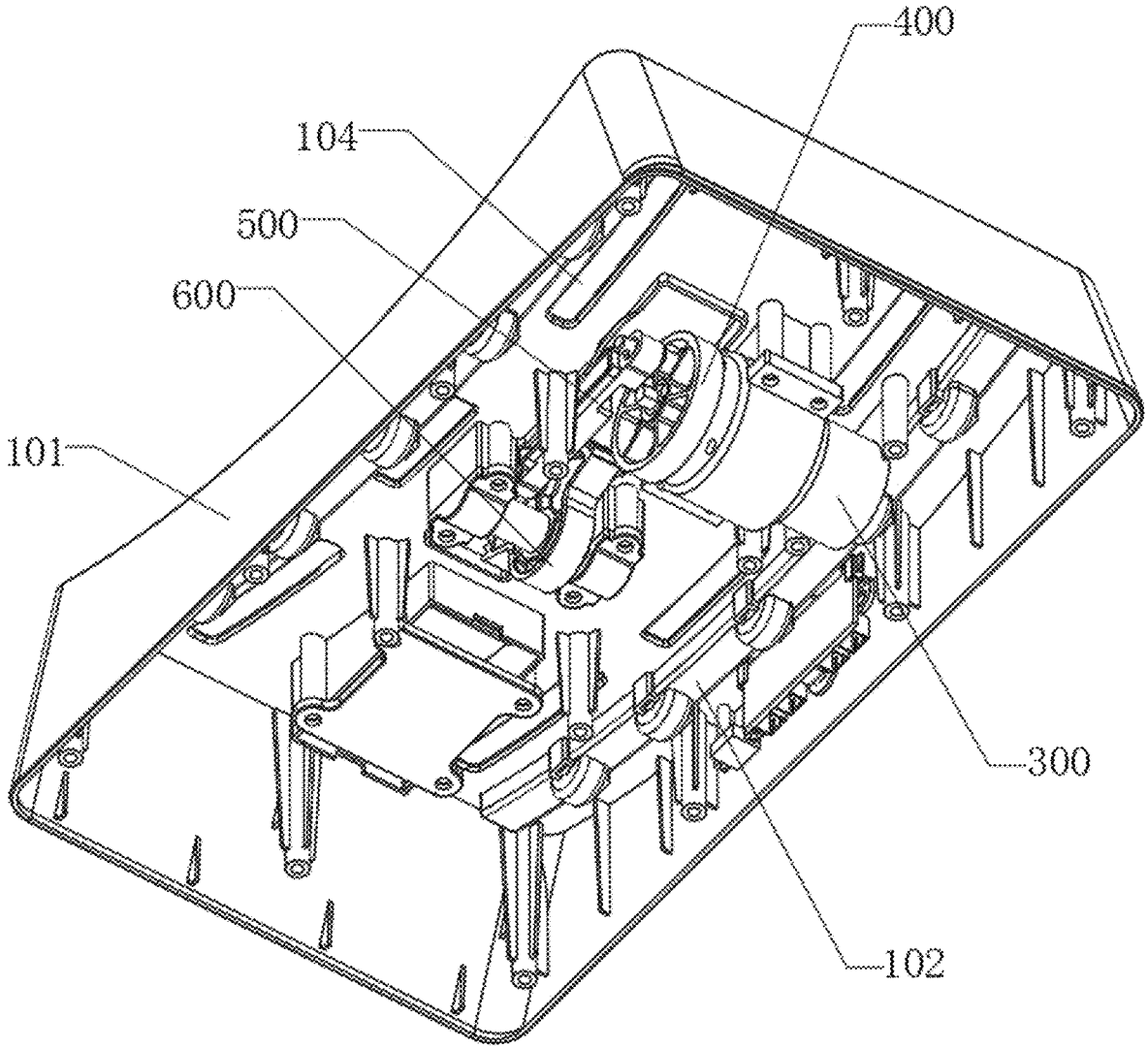
FIG. 9 is a schematic bottom view of an internal structure in FIG. 8.
Figure 10:
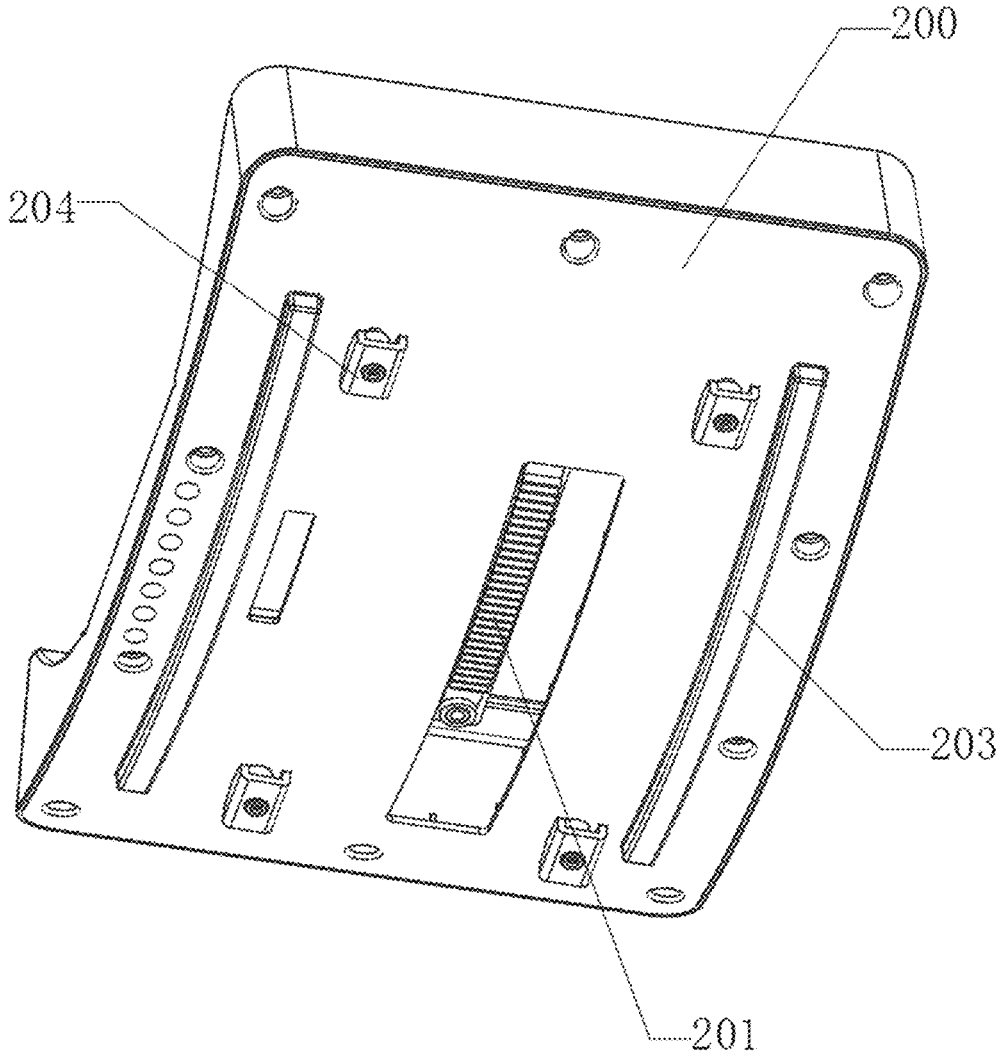
FIG. 10 shows a schematic structural bottom view of a shaking seat in the present disclosure.
Figure 11:
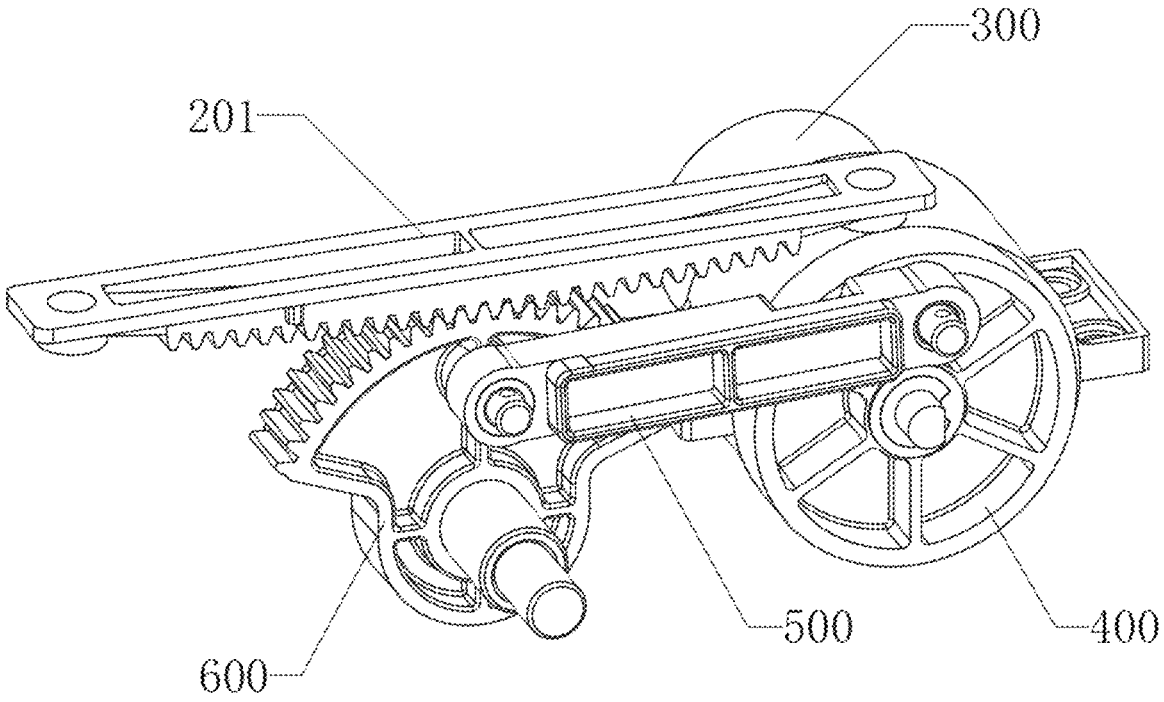
FIG. 11 shows a schematic structural diagram of a transmission mechanism and a linkage component in the present disclosure.
Figure 12:
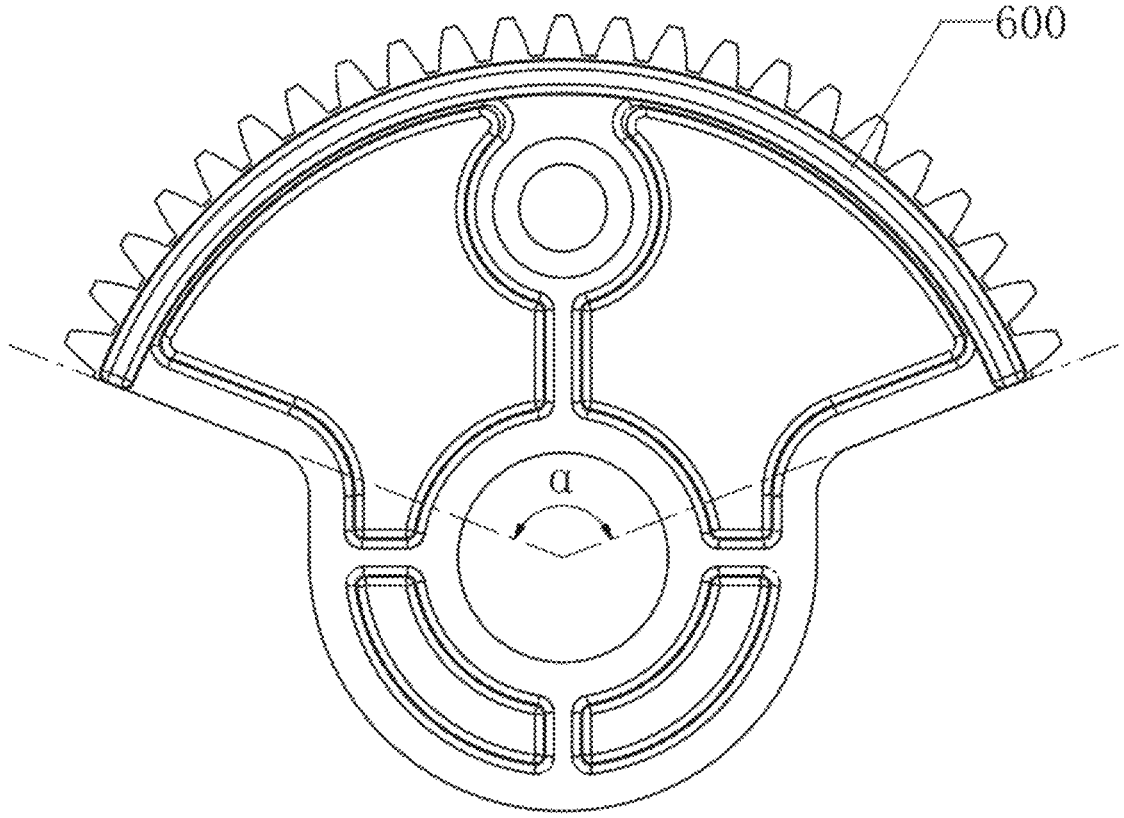
FIG. 12 shows a schematic structural diagram of a transmission gear in the present disclosure.

As shown in FIG. 6 to FIG. 8, a rolling-slip structure is arranged between the shaking seat 200 and the base assembly 100 and used to reduce friction force therebetween. By arranging the rolling-slip structure, the relative friction force between the shaking seat 200 and the base assembly 100 may be reduced, the smoothness of shaking of the shaking seat 200 relative to the base assembly 100 is improved, and the effects of reducing vibration and noise can also be achieved.

In the present embodiment, the rolling-slip structure includes a plurality of rollers 700, the plurality of rollers 700 are rotatably arranged on the base assembly 100, and the plurality of rollers 700 are in rolling connection with the shaking seat 200. Arc supporting parts 203 are arranged downwards extending from the shaking seat 200, and the arc supporting parts 203 are in rolling-supporting fit with the plurality of rollers 700. The addition of the arc supporting parts 203 increases the structural strength of the shaking seat 200, and then enhances the supporting performance of contact portions between the shaking seat 200 and the rollers 700, so that the load bearing capacity of the present disclosure is higher.

In the present embodiment, the base assembly 100 includes a bottom shell 101 and a fixing frame 102, the fixing frame 102 and the bottom shell 101 are buckled to form mounting grooves 105, the mounting grooves 105 communicate with the arc groove 103, the plurality of rollers 700 are rotatably arranged in the mounting groove 105, and two sides of the arc supporting parts 203 are in limiting fit with the mounting grooves 105. Through a limiting action of the mounting grooves 105 for the two sides of the arc supporting parts 203, a swing trajectory of the shaking seat 200 relative to the base assembly 100 is more consistent, and meanwhile, the addition of the mounting grooves 105 also enables the rollers 700 to be arranged on the base assembly 100 in a hidden manner, so that the attractiveness of the present disclosure is improved.

In other embodiments (not shown in the figure), the rollers 700 in the rolling-slip structure may be replaced with caterpillars or transmission belts, and the caterpillars or the transmission belts make contact with and are in rolling connection with the shaking seat 200, so that the contact area with the shaking seat 200 can be enlarged, which further improves the movement stability and load bearing capacity of the shaking seat 200.

Besides, in the present embodiment (not shown in the figure), the rollers 700, the caterpillars or the transmission belts in the rolling-slip structure may further have driving force and can rotate automatically, so that the shaking seat 200 may also be driven to swing back and forth, and the drive mechanism driving the shaking seat 200 to move is formed. As such, the present disclosure is simpler and more compact in structure, and the costs of machining and manufacturing are lowered.

The present disclosure has the basic working principle that:

the shaking seat 200 is slidably connected to the base assembly 100 through the guide mechanism, the decanting bottle is placed on the shaking seat 200, the drive motor 300 drives the shaking seat 200 to reciprocate left and right relative to the base assembly 100 through the transmission assembly, at the same time, during left-right movement of the shaking seat 200, under the guiding action of the guide mechanism, the shaking seat 200 is made to perform a curvilinear motion along the arc end face of the arc groove 103, and in the process that the decanting bottle shakes back and forth with the shaking seat 200, wine in the decanting bottle can make full contact with the air, so that the purpose of rapid decanting is achieved; and in addition, in the present disclosure, the swing trajectory of the shaking seat 200 is consistent with the curvature of the arc groove 103, when the shaking seat 200 swings to highest points of the two sides, the decanting bottle itself is also in a state of inclining inwards, and thus the surface area of the top of the wine is enlarged, the wine can be prevented from impacting the inner wall of the decanting bottle, and the wine is effectively prevented from spilling out. Therefore, the present disclosure has the effects that the decanting efficiency is high, and the wine is not prone to spilling out in the decanting process.

To sum up, it can be seen from the above description that, the present disclosure achieves the following technical effects:

the arc groove 103 is formed in the base assembly 100, the shaking seat 200 is slidably arranged on the arc groove 103 through the guide mechanism, the drive motor 300 is arranged in the base assembly 100, the drive motor 300 drives the rotary table 400 to rotate, the rotary table 400 drives the transmission gear 600 to rotate back and forth through the link rod 500, the transmission gear 600 is engaged with the rack 201 at the bottom of the shaking seat 200, such that the shaking seat 200 is driven to move left and right relative to the base assembly 100, meanwhile, under the guiding action of the guide mechanism, the shaking seat 200 is driven to swing back and forth along the arc end face of the arc groove 103, and the effects that the decanting efficiency is high, and the wine is not prone to spilling out in the decanting process are achieved.

By arranging the plurality of rollers 700 in the mounting grooves 105 of the base assembly 100, through the rolling connection of the rollers 700 with the arc supporting parts 203 at the bottom of the shaking seat 200, the relative friction force between the shaking seat 200 and the base assembly 100 is reduced, the smoothness of shaking of the shaking seat 200 relative to the base assembly 100 is improved, and the effects of reducing vibration and noise can also be achieved.

In the description of the present disclosure, it should be understood that, directional or positional relationships indicated by directional words such as "front, rear, upper, lower, left, right", "transverse, vertical, perpendicular, horizontal", and "top, bottom" are usually based on directional or positional relationships shown in the accompanying drawings, only for the ease of describing the present disclosure and simplifying the description. In the absence of contrary explanation, these directional words do not indicate or imply that devices or elements referred to must have a specific orientation or be constructed and operated in a specific orientation, and therefore cannot be understood as limiting the scope of protection of the present disclosure; and the directional words "inner, outer" refer to the inside and outside relative to own contours relative to each component itself.

For ease of description, spatial relative terms such as "above", "over", "on the upper surface of", "on", etc. can be used here to describe the spatial positional relationship between a device or feature shown in the drawing and other devices or features. It should be understood that the spatial relative terms are intended to encompass different orientations in use or operation in addition to the orientation of the devices described in the drawings. For example, if the devices in the drawings are inverted, the device described as "over other devices or structures" or "above other devices or structures" will be then positioned as "below other devices or structures" or "under other devices or structures". Therefore, the exemplary term "over" may include two orientations: "over" and "below". The device may also be positioned in other different ways (rotated by 90 degrees or in other orientations), and corresponding explanations should be provided for the spatial relative description used here.

In addition, it should be noted that the use of words such as "first" and "second" to define parts is for the purpose of distinguishing between corresponding parts conveniently. If not otherwise stated, the above words do not have a special meaning and therefore cannot be understood as limiting the scope of protection of the present disclosure.

The foregoing descriptions are only preferred embodiments of the present disclosure and are not used to limit the present disclosure. For those skilled in the art, the present disclosure can have various modifications and changes. Any modification, equivalent replacement, improvement, etc. made within the spirit and principle of the present disclosure should be included in the scope of protection of the present disclosure.

What is claimed is:

1. An automatic decanting apparatus, comprising a base assembly, a drive motor, a transmission assembly, a guide mechanism, a plurality of rollers, an arc supporting part and a shaking seat, wherein:

the transmission assembly is arranged between the base assembly and the shaking seat, the base assembly is provided with an arc groove adjacent the shaking seat, and the shaking seat is slidably arranged on the arc groove of the base assembly; and the shaking seat and the base assembly are slidably connected by the guide mechanism, the drive motor is in transmission connection with the transmission assembly, and under a guiding action of the guide the shaking seat is driven to swing back and forth along an arc end face of the arc groove;

the plurality of rollers are arranged between the shaking seat and the base assembly to reduce friction force therebetween;

the arc supporting part is arranged on the shaking seat in rolling-supporting fit with the plurality of rollers; and the base assembly comprises a bottom shell and a fixing frame, the fixing frame and the bottom shell are buckled to form a mounting groove, the mounting groove communicates with the arc groove, the plurality of rollers are rotatably arranged in the mounting groove, and two sides of the arc supporting part are in limiting fit with the mounting groove.

2. The automatic decanting apparatus according to claim 1, wherein: the guide mechanism comprises a guide member and a track groove, the track groove is formed in the base assembly, the track groove communicates with the arc groove, and the guide member is connected to the shaking seat.

3. The automatic decanting apparatus according to claim 1, comprising clamping parts used to clamp and fix a decanting bottle, the clamping parts are symmetrically arranged at an end of the shaking seat away from the base assembly.

4. The automatic decanting apparatus according to claim 1, wherein: the transmission assembly comprises a rack, a transmission gear and a linkage component, the rack is fixedly connected to the shaking seat, the transmission gear is rotatably connected to the base assembly, the rack and the transmission gear are engaged, and the drive motor drives the transmission gear to rotate back and forth through the linkage component.

5. The automatic decanting apparatus according to claim 4, wherein: the linkage component comprises a rotary table and a link rod, the rotary table is coaxially and fixedly arranged on an output shaft of the drive motor, one end of the link rod is rotatably connected to an eccentric site of the transmission gear, and the other end of the link rod is rotatably connected to an eccentric site of the rotary table.

6. The automatic decanting apparatus according to claim 4, wherein: the transmission gear is arranged as a sector gear, and a sector included angle of the sector gear is set to be 130° to 150°.

7. The automatic decanting apparatus according to claim 1, wherein: the plurality of rollers are rotatably arranged on the base assembly, and the plurality of rollers are in rolling connection with the shaking seat.

8. An automatic decanting apparatus, comprising a base assembly, a guide mechanism, a plurality of rollers, an arc groove, an arc supporting part and a shaking seat movably arranged on the base assembly, wherein:

the base assembly has a moving area defined by the arc groove, the moving area allowing the shaking seat to move with an arc trajectory, and the shaking seat reciprocates in the moving area;

the guide mechanism is arranged between the shaking seat and the base assembly, and the guide mechanism is used to connect the shaking seat and the base assembly, and guide the shaking seat to move along the arc trajectory;

the plurality of rollers are arranged between the shaking seat and the base assembly to reduce friction force therebetween;

the arc supporting part is arranged on the shaking seat in rolling-supporting fit with the plurality of rollers; and the base assembly comprises a bottom shell and a fixing frame, the fixing frame and the bottom shell are buckled to form a mounting groove, the mounting groove communicates with the arc groove, the plurality of rollers are rotatably arranged in the mounting groove, and two sides of the arc supporting part are in limiting fit with the mounting groove; and at least one of the base assembly or the shaking seat is provided with a drive mechanism used to drive the shaking seat to reciprocate automatically.

9. The automatic decanting apparatus according to claim 8, wherein: the moving area is defined by the arc groove formed in a surface of the bottom shell.

10. The automatic decanting apparatus according to claim 9, wherein: a side face of the shaking seat facing the bottom shell is correspondingly arranged in an arc shape, with a curvature consistent with a curvature of the arc groove.

11. The automatic decanting apparatus according to claim 10, wherein: the guide mechanism comprises a guide member and a track groove, and the track groove is formed in the arc groove.

12. The automatic decanting apparatus according to claim 11, wherein: the guide member is fixed to a surface of the shaking seat facing the bottom shell, the guide member is embedded into the track groove and is in sliding connection with the track groove.

13. The automatic decanting apparatus according to claim 8, wherein: the drive mechanism comprises a transmission assembly and a drive motor, and the drive motor drives the shaking seat to swing back and forth along the moving area through the transmission assembly.

14. The automatic decanting apparatus according to claim 13, wherein: the transmission assembly comprises a rack, a transmission gear and a linkage component, the rack is fixedly connected to the shaking seat, and the transmission gear is rotatably connected to the base assembly.

15. The automatic decanting apparatus according to claim 14, wherein, the rack and the transmission gear are engaged, and the drive motor drives the transmission gear to rotate back and forth through the linkage component.

* * * * *